US008690200B1

(12) United States Patent
Patterson, Jr.

(10) Patent No.: US 8,690,200 B1
(45) Date of Patent: Apr. 8, 2014

(54) RADIALLY-INSERTED ANTI-ROTATION KEY FOR THREADED CONNECTORS

(71) Applicant: Vetco Gray Inc., Houston, TX (US)

(72) Inventor: William R. Patterson, Jr., Houston, TX (US)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 13/713,975

(22) Filed: Dec. 13, 2012

(51) Int. Cl.
*F16L 21/00* (2006.01)

(52) U.S. Cl.
USPC ..... 285/403; 285/92

(58) Field of Classification Search
USPC ..... 285/333, 36, 90, 92, 403, 404
See application file for complete search history.

(56) References Cited

U.S. PATENT DOCUMENTS

| | | | | | |
|---|---|---|---|---|---|
| 1,969,431 | A * | 8/1934 | Skinner | 285/36 |
| 2,440,257 | A * | 4/1948 | Edwards | 285/36 |
| 2,535,435 | A * | 12/1950 | Massey | 285/36 |
| 3,472,538 | A * | 10/1969 | Wilder et al. | 285/374 |
| 3,827,728 | A * | 8/1974 | Hynes | 285/90 |
| 4,094,539 | A * | 6/1978 | Reimert | 285/309 |
| 4,653,778 | A * | 3/1987 | Alandy | 285/18 |
| 4,711,471 | A | 12/1987 | Pallini, Jr. et al. | |
| 4,757,593 | A | 7/1988 | Pallini, Jr. et al. | |
| 4,830,408 | A * | 5/1989 | Reimert | 285/27 |
| 4,902,047 | A | 2/1990 | Marietta et al. | |
| 5,044,676 | A | 9/1991 | Burton et al. | |
| 5,333,911 | A * | 8/1994 | Watkins | 285/18 |
| 6,328,343 | B1 * | 12/2001 | Hosie et al. | 285/90 |
| 6,619,392 | B2 | 9/2003 | Marangoni et al. | |
| 6,695,059 | B2 | 2/2004 | Thomas et al. | |
| 7,146,704 | B2 | 12/2006 | Otten et al. | |
| 7,559,583 | B2 * | 7/2009 | Stoetzer | 285/403 |
| 2011/0260445 | A1 | 10/2011 | Watterson, II et al. | |
| 2012/0103625 | A1 | 5/2012 | Yates | |

* cited by examiner

*Primary Examiner* — Aaron Dunwoody
(74) *Attorney, Agent, or Firm* — Bracewell & Giuliani LLP

(57) ABSTRACT

A pipe connection includes a box that mates with a pin. A box slot extends through a side wall of the box at a point adjacent the rim for alignment with a pin slot formed on the pin. Each of the slots has a circumferential dimension and an axial dimension that is less than the circumferential dimension. The pin slot has a greater circumferential dimension than the box slot. A locking key has a pin section and a box section located within the pin slot and the box slot, respectively, when the key is installed. The pin section has teeth that bite into the pin slot. The key has a width substantially the same as the circumferential dimension of the box slot.

20 Claims, 4 Drawing Sheets

RADIALLY-INSERTED ANTI-ROTATION KEY FOR THREADED CONNECTORS

FIELD OF THE DISCLOSURE

This disclosure relates in general to tubular connections, such as for offshore oil well large diameter pipe, and particularly to a device to prevent rotation of the members after they are made up.

BACKGROUND OF THE INVENTION

Oil and gas wells can have several strings of casing of differing diameters cemented in the well. Each casing string is usually made up of joints of pipe having threaded ends secured together. A typical casing joint has external threads on its upper and lower ends. A casing collar with internal threads secures the threaded ends together. In larger casing diameters, a casing collar with internal threads may be affixed, such as by welding, to one end of each pipe, the other end having external threads. Normally, the operator relies on the friction of the made-up joint preventing the threaded connectors from loosening while running the string into the well. With larger diameter casing, for example, from 16 inch to 36 inch, the friction of the made-up connector may be inadequate to prevent loosening while running the casing.

Operators have employed anti-rotation keys to prevent loosening. In one type, a rectangular pocket or slot is machined on the outer surface of the pin connector. The box connector is machined to include tabs that accept the anti-rotation key. The box connector tab and pin connector pocket will line up after making up the connectors. The workers will then drive a key through the box connector tab and into the pin connector pocket. The key has a slightly greater thickness than the distance from the box connector tab to the innermost wall of the pin connector pocket, resulting in an interference fit. The workers typically will drive the key into place with a hammer.

When the casing is under load, with some designs, the key can loosen. Some designs require specialty tools to install the locking mechanism. Some designs require explosive powered guns to set the locking mechanism. Other designs can be difficult to unlock in the event it is necessary to unscrew the pipe connection. Another design requires drilling a hole for the locking member after the pipe connection is made up. Drilling can result in metal shavings falling down the pipe string, which can cause issues. Further, drilling a made up pipe connection requires a complex drill. If disconnected, then reconnected, it may be necessary to drill another hole, and that hole may overlap the previously drilled hole, limiting the locking capacity.

SUMMARY

The pipe connection has a box and a pin with mating threads. A box slot extends through a side wall of the box adjacent the internal threads. A pin slot is formed in the pin adjacent the external threads. Each of the slots has a circumferential dimension and an axial dimension that is less than the circumferential dimension. If the slot is on the pin, it could extend completely around the circumference of the pin. One of the slots has a greater circumferential dimension than the other of the slots to enable alignment of the slots when the pin and the box are made up with each other. A locking key has a pin section joining and radially inward from a box section. The pin section and the box section are located within the pin slot and the box slot, respectively, when the key is installed.

One of the sections has at least one tooth that bites into the slot having the greater circumferential dimension. The locking key has a width substantially the same as the slot having the lesser circumferential dimension.

The key has a radial length from an outer end to an inner end. The tooth is elongated and extends generally radially along the key. Preferably, a plurality of the teeth are located on an upper side and on a lower side of the key. The teeth have a radial length substantially equal to a radial length of said one of the sections. The pin section of the key has a radial length substantially equal to a depth of the pin slot. The box section of the key has a radial length substantially equal to a radial dimension of the box slot. The teeth are located only on said one of the sections and not on the other of the sections, which reduces the installation force by approximately one-half.

A threaded jacking bolt is secured in a hole extending from an inner end to an outer end of the key for removing the key. A set screw is secured within a hole in the box section of the key. The set screw hole extends from the outer end to a side edge of the key at an angle relative to a radial line passing through the key so as to engage a side edge of the box slot.

In the first embodiment, each section of the key has the same axial thickness. In the first embodiment, the slot with the greater circumferential dimension has a lesser axial dimension than the slot with the lesser circumferential dimension. In the second embodiment, the slots have the same axial dimension. In the second embodiment, the section of the key having the teeth has a greater axial thickness than the other of the sections.

DETAILED DESCRIPTION

Figure 1:
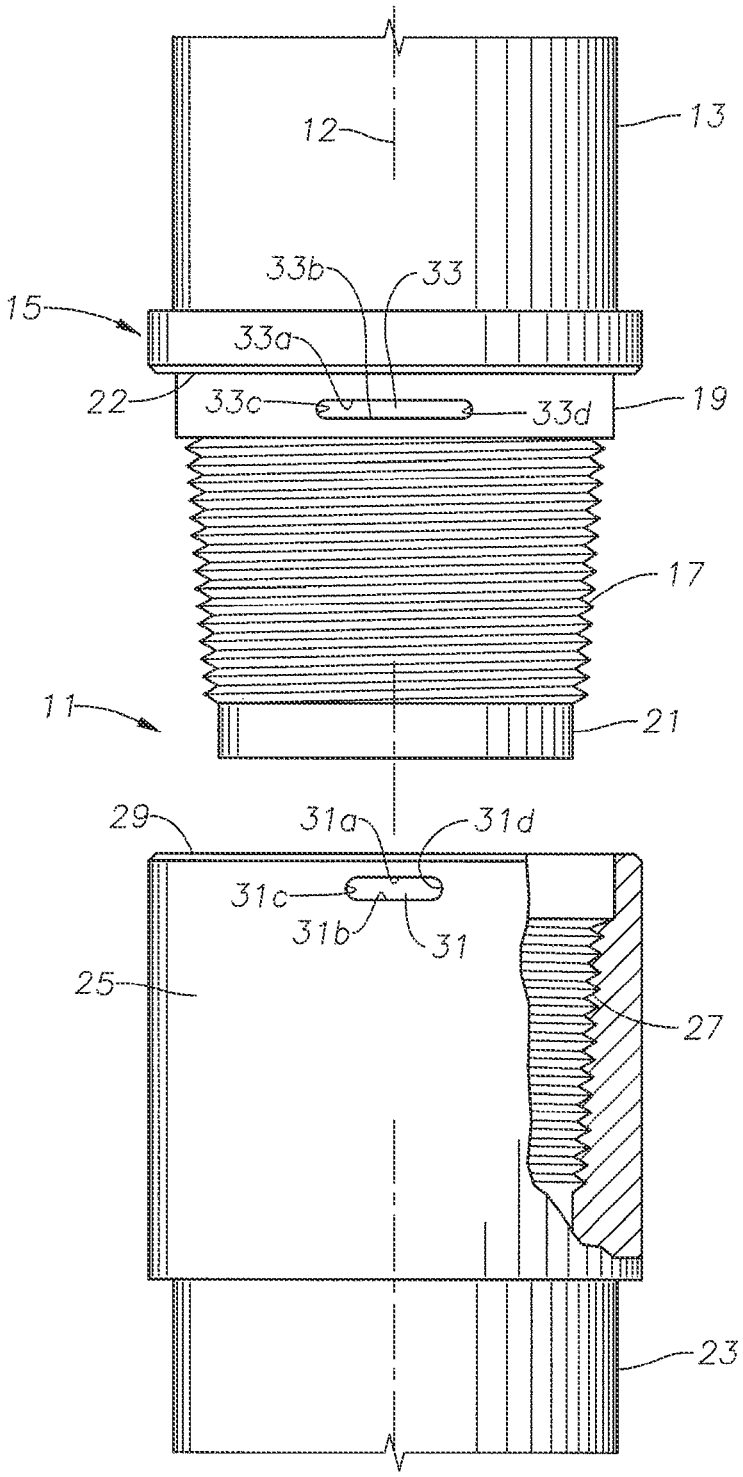
FIG. 1 is an exploded side elevation view of a pin and box of a pipe connection constructed in accordance with this disclosure.

Referring to FIG. 1, pipe connection 11 is typically used for connecting large diameter well casing, particularly for offshore wells. An upper pipe 13 is illustrated as having a pin 15 on a lower end. The terms "upper" and "lower" are used only for convenience as pin 15 could be on the upper end of pipe 13. Pin 15 has external threads 17 formed on a conical surface. A band 19 encircles pin 15 at the upper end of threads 17. Pin 15 also has a nose on its lower end that comprises a band 21 directly below threads 17. A downward-facing shoulder 22 is located directly above band 19.

Figure 4:
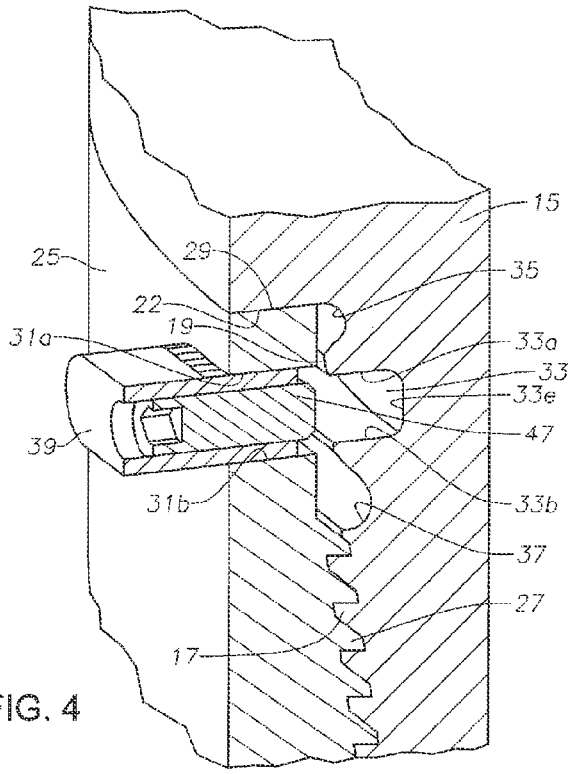
FIG. 4 is a partially sectioned perspective view of the pin and box of FIG. 1 made up, and the key of FIG. 2 being inserted into respective slots.
Figure 5:
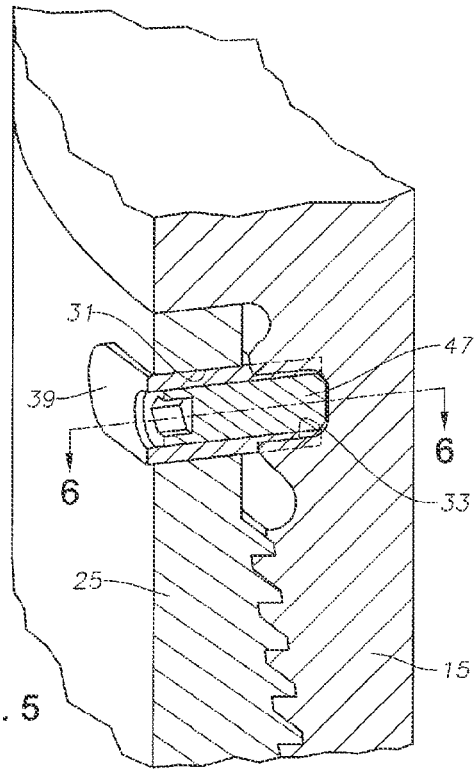
FIG. 5 is a partially sectioned perspective view similar to FIG. 4, but showing the key fully inserted into the slots.

A lower pipe 23 has a box 25 on its upper end. Box 25 has internal threads 27 that mate with external threads 17. A rim 29 defines an upper end of box 25. When made up, as shown in FIGS. 4 and 5, rim 29 abuts the downward-facing shoulder 22 of pin 15. Box 25 has a box slot 31 comprising a hole extending through a side wall of box 25 between rim 29 and internal threads 27. Upper pipe 13 will typically have a box 25 on its upper end, and lower pipe 23 will have a pin 15 on its lower end.

Figure 6:
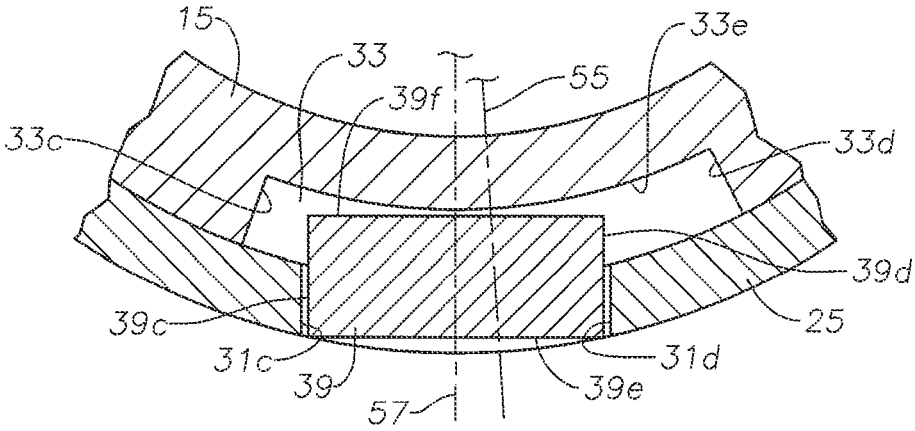
FIG. 6 is a sectional view of the pin, box and key taken along the line 6-6 of FIG. 5.

Box slot 31 has an upper side 31*a*, a lower side 31*b*, and opposite side edges 31*c* and 31*d*. Upper side 31*a* and lower side 31*b* are parallel with each other and in planes perpendicular to connection axis 12. The axial dimension from upper side 31*a* to lower side 31*b* is considerably less than the circumferential dimension measured from side edge 31*c* to side edge 31*d*. Side edges 31*c* and 31*d* could be flat surfaces or concave. Side edges 31*c* and 31*d* could extend along radial lines emanating from axis 12; or they could be on lines that are parallel with each other, as illustrated in FIG. 6. If side edges 31*c*, 31*d* are on radial lines, box slot 31 will have a slightly less circumferential dimension on the inner surface of box 25 than on the outer surface.

A pin slot 33 is formed in band 19 of pin 15. Pin slot 33 has an upper side 33*a* and lower side 33*b* that are parallel with each other and perpendicular to axis 12. Pin slot 33 has opposite side edges 33*c* and 33*d*. Optionally, pin slot 31 could extend entirely around the circumference of pin 15, in which case it would not have side edges 33*c*, 33*d*, Pin slot 33 does not extend completely through the side wall of pin 15; rather it has an outward-facing base 33*e*, shown in FIGS. 4-6. Base 33*e* may be flat or it may be a segment of a cylinder, as illustrated in FIG. 6. Side edges 33*c* and 33*d* may be flat or concave. Also, side edges 33*c* and 33*d* may be on radial lines, as shown in FIG. 6, or on lines parallel to each other. Referring to FIGS. 4 and 5, pin base 19 may have stress relief grooves 35, 37 that encircle band 19. Pin slot 33 is located between stress relief grooves 35, 37.

In the first embodiment, the circumferential dimension of pin slot 33 from side edge 33*c* to side edge 33*d* is much greater than the circumferential dimension of box slot 31. For example, the circumferential length of box slot 31 may be in the range from 40% to 50% the circumferential length of pin slot 33. If pin slot 33 is configured to extend completely around 15 pin 15, the circumferential length of pin slot 33 would be the circumference of band 19. The greater length of pin slot 33 assures that when connection 11 is fully made up, box slot 31 will be aligned with pin slot 33. The alignment need not precisely center box slot 31 with pin slot 33. However, box slot side edges 31*c* and 31*d* should be radially located between radial lines extending from pin slot side edges 33*c* and 33*d*.

Pin slot 33 has a much smaller axial dimension from upper side 33*a* to lower side 33*b* than the circumferential dimension between side edges 33*c* and 33*d*. Also, in the first embodiment, pin slot 33 has a slightly smaller axial dimension from upper side 33*a* to lower side 33*b* than the axial dimension of box slot 31.

Figure 2:
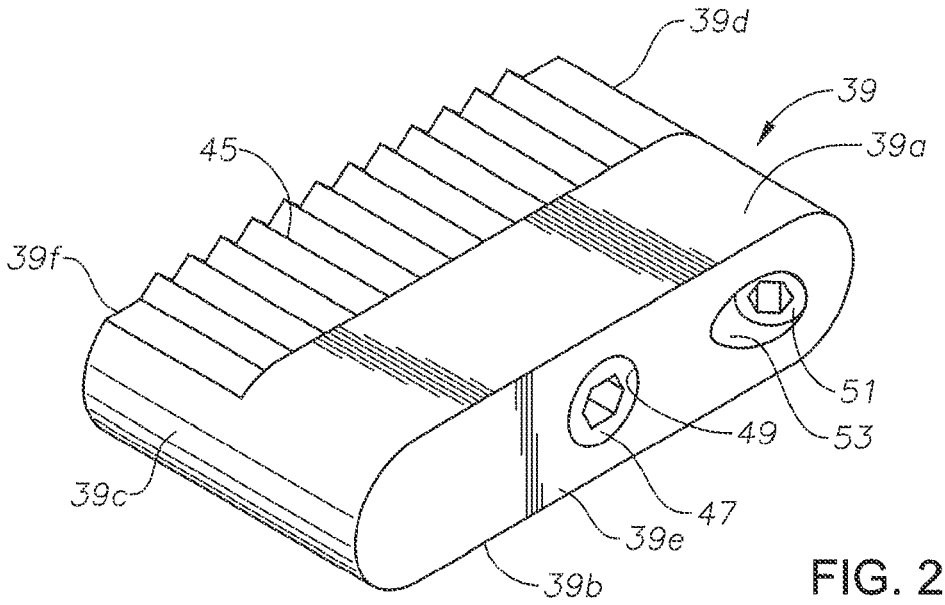
FIG. 2 is an enlarged perspective view of a locking key of the pipe connection of FIG. 1, shown from an outer end.
Figure 3:
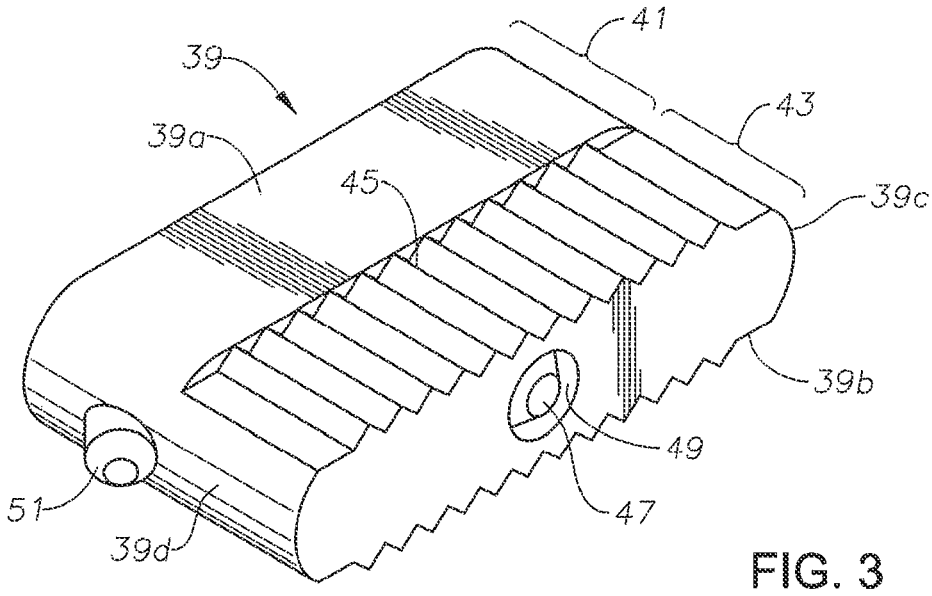
FIG. 3 is another perspective view of the locking key of FIG. 2, shown from an inner end.

Referring to FIGS. 2 and 3, a locking key 39 is inserted into box slot 31 and pin slot 33 after connection 11 is fully made up. Key 39 is a generally rectangular member having an upper side 39*a*, a lower side 39*b*, opposite side edges 39*c*, 39*d*, an outer end 39*e* and an inner end 39*f*. In the embodiment shown, outer end 39*e* and inner end 39*f* are flat and parallel to each other. However, inner end 39*f* could be a segment of a cylinder to mate with pin slot base 33*e* (FIG. 6), which is partially cylindrical. Side edges 39*c*, 39*d* are illustrated as being convex, but they could be flat.

Key 39 has a box section 41 that extends radially inward from outer end 39*e* up to a distance at least equal to the radial dimension of box slot 31. It is not necessary that the outer side of key 39 be flush with the outer diameter of box 25, so the radial length of box section 41 could be less than the radial dimension of box slot 31. Upper side 39*a* and lower side 39*b* in box section 41 are flat and parallel with each other. Key 39 also has a pin section 43 that extends inward from box section 41 to inner end 39*f*. Pin section 43 has a plurality of grooves formed therein to create teeth 45. Teeth 45 are triangular shaped in cross-section, each having a sharp crest. Other shapes for teeth 45 are feasible, such as an asymmetric shape. Teeth 45 are elongated, parallel with each other, and extend generally radially from the junction with pin section 43 to inner end 39*f*. Teeth 45 are located both on upper side 39*a* and lower side 39*b*.

Key 39 has a width, which is a dimension from side edge 39*c* to side edge 39*d*, that substantially equals or is slightly less than the circumferential dimension of box slot 31. When installed in box slot 31, side edges 39*c*, 39*d* will be in contact or nearly in contact with box slot side edges 31*c* and 31*d*. The width of key 39 is thus considerably less than the circumferential dimension of pin slot 33. In this embodiment, the axial dimension or thickness from upper side 39*a* to lower side 39*b* is the same in box section 41 as in the pin section 43 of key 39. The axial thickness is substantially the same as or slightly less than the axial dimension of box slot 31 from upper side 31*a* to lower side 31*b*. Consequently, key 39 passes freely into box slot 31. The axial thickness of key 39 is greater than the axial dimension of pin slot 33. That is, the axial distance from the crests of teeth 45 on upper side 39*a* to the crests of teeth 45 on the lower side 39*b* is slightly greater than the axial dimension of pin slot 33 so as to cause teeth 45 to bite into and permanently deform pin slot upper side 33*a* and pin slot lower side 33*b*.

A jacking bolt 47 is located in a threaded hole 49 that extends from key outer end 39*e* to key inner end 39*f*. Jacking bolt 47 engages threads in hole 49 and has a length approximately equal to the radial length of key 39. If removing key 39 is desired, when rotated in one direction, jacking bolt 47 will move inward, pressing against pin slot base 33*e* to push key 39 outward. Other removal devices rather than jacking bolt 47 are feasible. For example, forming a notch in key 39 and box 25 would allow a tool to be inserted to pry out key 39.

An optional set screw 51 is located in a threaded hole 53 that is skewed at an angle relative to a radial line passing through key 39. Set screw hole 53 has one end at key outer end 39*e* and another end at side edge 39*d*. Set screw 51 has a convex, somewhat pointed inner end, such that when rotated inward, the inner end will protrude from key side edge 39*d* and embed or at least frictionally engage box slot side edge 31*d*. The frictional engagement retards key 39 from loosening its engagement with box 25. Set screw hole 53 could alternately be located on side edge 39*c*. Set screw 51 could alternately engage a threaded hole in box slot side edge 31*d*. Alternately, set screw 31 could extend through a hole in box 25 oriented so that its tip engages key 39.

In the operation of the first embodiment, pin 15 will be rotated into box 25 to a full make-up position. It is difficult to precisely determine in advance the precise clocking point at full make-up position. Each pipe connection 11 could differ in a string of pipe. As shown in FIG. 1, slots 31, 33 will be radially aligned with each other, although probably not precisely aligned, at full make-up. A radially extending pin slot center line 55 equidistant between pin slot side edges 33*c*, 33*b* will likely not coincide with a radially extending box slot center line 57 located between box slot side edges 31*c*, 31*d*. However, at full make-up, slots 31, 33 will be aligned in that box slot side edges 31*c*, 31*d* are located between radial lines passing through pin slot side edges 33*c*, 33*d*. Consequently key 39 may be inserted through box slot 31 into pin slot 33.

Initially, pin section 43 of key 39 is inserted into box slot 31, as shown in FIG. 4. Very little force is required to insert key 39 to the position in FIG. 4. In the position of FIG. 4, pin section 43 is within box slot 31, and box section 41 has not yet entered box slot 31. Then the user employs a tool, such as a hamper or press, to push key 39 further inward. Teeth 45 embed or bite pin slot upper and lower sides 33*a* and 33*b*. When fully inserted, key inner end 39*f* is in abutment with pin slot base 33*e*, and key outer end 39*e* is substantially flush with the exterior of box 25. The engagement of teeth 45 with pin slot 33 will prevent any rotation of pin 15 relative to key 39. Box 25 will not rotate relative to key 39 because of the close fit of key 39 in box slot 31. Key 39 thus prevents pin 15 and box 25 from inadvertently unscrewing from each other.

Figure 7:
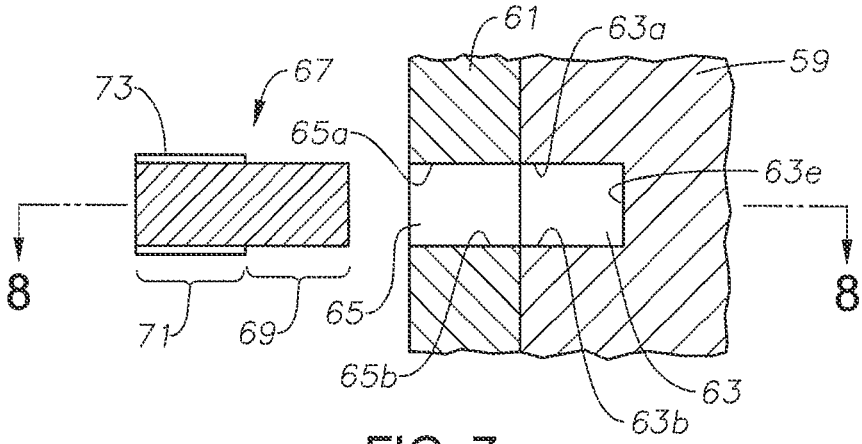
FIG. 7 is an exploded sectional view of a pin, box and key in accordance with an alternate embodiment.
Figure 8:
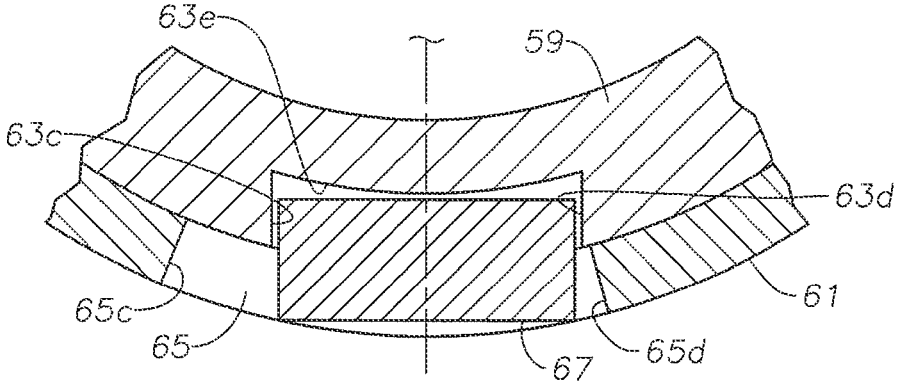
FIG. 8 is a sectional view of the pin, box and key with the key installed of FIG. 7, taken along the line 8-8 of FIG. 7.

The second embodiment illustrated in FIGS. 7 and 8 reverses the arrangement of the slots of the first embodiment. Pin 59 and box 61 threadingly engage each other as in the first embodiment. Pin slot 63 is in the same general location as in the first embodiment. Pin slot 63 has an upper side 63*a*, a lower side 63*b*, opposite side edges 63*c*, 63*d*, and a base 63*e*. Box slot 65 is in the same general location as in the first embodiment. Box slot 65 has an upper side 65*a*, a lower side 65*b*, and opposite side edges 65*c*, 65*d*. Opposite to the first embodiment, the circumferential dimension from pin slot side edge 63*c* to side edge 63*d* is less than the circumferential dimension of box slot 65. The circumferential dimension from box slot side edge 65*b* to side edge 65*c* is considerably greater than the circumferential dimension of pin slot 63. Also, unlike the first embodiment, the axial dimension of pin slot 63 may be the same as the axial dimension of box slot 65. The axial dimension from pin slot upper side 63*a* to pin slot lower side 63*b* is at least equal to the axial dimension from box slot upper side 65*a* to box slot lower side 65*b*.

Key 67 has a pin section 69 that engages pin slot 63 and a box section 71 that engages box slot 65. Unlike the first embodiment, teeth 73 are formed on box section 71 instead of on pin section 69. Teeth 73 are similar in configuration to the first embodiment and are located in box section 71 on both the upper and lower sides 67*a*, 67*b* of key 67. In this embodiment, the axial thickness of key 67 from the crests of teeth 73 on upper side 67*a* to the crests of teeth 73 on lower side 67*b* is greater in box section 71 than in pin section 69. The axial thickness of key 67 in box section 71 is greater than the axial dimension of box slot 65. The width of key 67 is the same or slightly less than the circumferential dimension of pin slot 63.

During assembly, after pin 59 and box 61 are fully made up, a worker inserts pin section 69 of key 67 into box slot 65. Very little, if any, force is required to insert pin section 69 into box slot 65 because the axial thickness of pin section 69 is not greater than the axial dimension of box slot 65. The operator then employs a tool to drive box section 71 into box slot 65, causing teeth 73 to bite into box slot upper and lower sides 65*a*, 65*b*. Pin section 69 slides freely into pin slot 63, as illustrated in FIG. 8. Pin 59 cannot rotate relative to key 67 because of the snug fit of pin section 69 in pin slot 63. Box 61 cannot rotate relative to key 67 because of the engagement of teeth 73. A jacking bolt (not shown) could also be installed in key 67.

While the disclosure has been shown in only two of its forms, it should be apparent to those skilled in the art that it is not so limited but is susceptible to various changes without departing from the scope of the disclosure.

The invention claimed is:

1. A pipe connection, comprising:

a box with internal threads;

a pin with external threads that mate with the internal threads of the box;

a box slot extending through a side wall of the box;

a pin slot formed in the pin;

each of the slots having a circumferential dimension and an axial dimension, relative to an axis of the connection, that is less than the circumferential dimension;

the circumferential dimension of one of the slots being greater than the circumferential dimension of the other of the slots to enable alignment of the slots when the pin and the box are made up with each other; and a locking key that has a pin section joining and radially inward from a box section, the pin section and the box section being located within the pin slot and the box slot, respectively, when the key is installed, one of the sections having at least one tooth that bites into and permanently deforms the slot having the greater circumferential dimension when the key is installed, the key having a width substantially the same as the slot having the lesser circumferential dimension.

2. The pipe connection according to claim 1, wherein:

the key has a radial length from an outer end to an inner end; and the tooth is elongated and extends generally radially along the key and has a radial length greater than a width measured transverse to the radial length.

3. The pipe connection according to claim 2, wherein said at least one tooth comprises a plurality of teeth on the upper side and on the lower side of the key.

4. The pipe connection according to claim 1 wherein the tooth has a radial length substantially equal to a radial length of said one of the sections.

5. The pipe connection according to claim 1 wherein:

the pin section of the key has a radial length substantially equal to a depth of the pin slot;

the box section of the key has a radial length substantially equal to a radial dimension of the box slot; and the tooth is located only on said one of the sections and not on the other of the sections.

6. The pipe connection according to claim 1, wherein;

the section of the key containing the tooth has an axial dimension that is greater than an axial dimension of the slot having the greater circumferential dimension.

7. The pipe connection according to claim 1, further comprising:

a threaded jacking bolt secured in a hole extending from an inner end to an outer end of the key for removing the key.

8. The pipe connection according to claim 1, further comprising a set screw secured within a hole in the box section of the key, the hole extending from an outer end to a side edge of the key at an angle relative to a radial line so as to engage a side edge of the box slot.

9. The pipe connection according to claim 1, wherein the slot with the greater circumferential dimension has a lesser axial dimension than the slot with the lesser circumferential dimension.

10. The pipe connection according to claim 1, wherein the section of the key having the tooth has a greater axial thickness than the other of the sections.

11. The pipe connection according to claim 1, wherein each of the sections of the key has a same axial thickness.

12. A pipe connection, comprising:

a box with internal threads and a rim;

a pin with external threads that mate with the internal threads, the pin having a band adjacent the internal threads;

a box slot extending through a side wall of the box at a point between the rim and the internal threads;

a pin slot formed in the band on the pin;

each of the slots having a circumferential dimension and an axial dimension, relative to an axis of the connection, that is less than the circumferential dimension;

the circumferential dimension of the pin slot being greater than the circumferential dimension of the box slot to enable alignment of the slots when the pin and the box are made up with each other; and a locking key that has a pin section joining and radially inward from a box section, the pin section and the box section being located within the pin slot and the box slot, respectively, when the key is installed, the pin section having a plurality of teeth that bite into the pin slot, and the locking key having a width substantially the same as the circumferential dimension of the box slot.

13. The pipe connection according to claim 12, wherein: the pin section of the key is free of any of the teeth.

14. The pipe connection according to claim 12, wherein: the teeth extend generally radially and have lengths substantially equal to a radial length of the pin section.

15. The pipe connection according to claim 12, wherein the teeth are located on an upper side and a lower side of the key.

16. The pipe connection according to claim 12, wherein the axial dimension of the pin slot is less than the axial dimension of the box slot.

17. The pipe connection according to claim 12, wherein an axial thickness of the box section of the key is the same as an axial thickness of the pin section of the key.

18. The pipe connection according to claim 12, further comprising a set screw secured within a hole in the box section of the key, the hole for the set screw being at an angle relative to a radial line passing through the key and extending from an outer end of the key to a side edge of the key so as to engage a side edge of the box slot.

19. A method of locking a pipe connection having a box with internal threads and a pin with external threads, comprising:

providing a box slot through a side wall of the box adjacent the internal threads and a pin slot in the pin adjacent the external threads, one of the slots having a greater circumferential dimension than the other of the slots;

screwing the box and the pin together to a full make-up torque, the slots being positioned to cause the slot with the smaller circumferential dimension to be aligned within the slot having the larger circumferential dimension when the box and the pin are fully made up;

providing a locking key with a width substantially the same as the smaller circumferential dimension and at least one tooth; and pushing the key through the pin slot and into the box slot, and causing the teeth to bite into the slot having the greater circumferential dimension.

20. The method according to claim 18, further comprising retracting the key to unlock the connection, comprising:

providing a hole in the key extending from an inner end to an outer end, and providing the hole with threads;

inserting a jacking bolt in the hole; and rotating the jacking bolt to cause an inner end of the jacking bolt to engage and push against a base of the pin slot, thereby retracting the key from the pin slot.

* * * * *